US007766265B2

(12) United States Patent
Wang

(10) Patent No.: US 7,766,265 B2
(45) Date of Patent: Aug. 3, 2010

(54) SWINGING DEVICE FOR INCREASING CAPACITY OF TRASH BIN

(75) Inventor: Tie-Chun Wang, Taipei Hsien (TW)

(73) Assignee: Michilin Prosperity Co., Ltd. (TW)

( * ) Notice: Subject to any disclaimer, the term of this patent is extended or adjusted under 35 U.S.C. 154(b) by 241 days.

(21) Appl. No.: 11/981,158

(22) Filed: Oct. 31, 2007

(65) Prior Publication Data

US 2009/0050643 A1 Feb. 26, 2009

(30) Foreign Application Priority Data

Aug. 20, 2007 (TW) ..... 96213791 U

(51) Int. Cl.
*B02B 7/02* (2006.01)
*B02C 23/00* (2006.01)

(52) U.S. Cl. ..... 241/100; 100/233

(58) Field of Classification Search ..... 241/100; 100/233, 266; 220/825, 827, 830, 263, 264, 220/908
See application file for complete search history.

(56) References Cited

U.S. PATENT DOCUMENTS

| | | | | | |
|---|---|---|---|---|---|
| 791,948 | A | * | 6/1905 | Savell | 100/262 |
| 942,443 | A | | 12/1909 | Gallaread | |
| 1,090,914 | A | | 3/1914 | Guettler | |
| 1,456,265 | A | | 5/1923 | Brooks | |
| 2,230,019 | A | * | 1/1941 | Tucke | 241/99 |
| 2,700,333 | A | * | 1/1955 | Polsen et al. | 100/229 R |
| 3,137,332 | A | | 6/1964 | Bertil | |
| 3,333,617 | A | | 8/1967 | Gottfried et al. | |
| 3,696,737 | A | | 10/1972 | Wikner | |
| 3,727,546 | A | * | 4/1973 | McKinney | 100/229 A |
| 3,771,437 | A | * | 11/1973 | Brucken | 100/52 |
| 3,919,932 | A | * | 11/1975 | Basuino | 100/228 |
| 4,164,178 | A | | 8/1979 | Baumann et al. | |
| 4,285,273 | A | * | 8/1981 | Dejarnett | 100/35 |
| 4,286,515 | A | | 9/1981 | Baumann et al. | |
| 4,403,519 | A | | 9/1983 | Welker | |
| 5,016,828 | A | | 5/1991 | Utsumi et al. | |
| 5,041,374 | A | | 8/1991 | Chu et al. | |
| 5,080,011 | A | * | 1/1992 | Paxton et al. | 100/229 A |
| 5,090,309 | A | * | 2/1992 | Lai | 100/226 |
| 5,121,850 | A | | 6/1992 | Morel | |
| 5,221,052 | A | | 6/1993 | Vega | |
| 5,440,978 | A | | 8/1995 | O'Brien et al. | |
| 5,588,358 | A | | 12/1996 | Klepacki et al. | |
| 5,768,988 | A | | 6/1998 | Meloni | |
| 5,771,794 | A | | 6/1998 | Benizri et al. | |
| 5,884,556 | A | | 3/1999 | Klepacki et al. | |
| 5,960,710 | A | | 10/1999 | Holtom | |
| 6,550,701 | B1 | | 4/2003 | Chang | |
| 6,851,354 | B2 | | 2/2005 | Morisse | |

(Continued)

*Primary Examiner*—Bena Miller
(74) *Attorney, Agent, or Firm*—Venable LLP; Stefan J. Kirchanski

(57) ABSTRACT

A swinging device for increasing the capacity of a trash bin includes a pushing assembly penetrating through the shredder body, a stirring board disposed at the bottom of the shredder body, and a shaft connecting the pushing assembly and the stirring board. The shaft converts the vertical displacement motion of the pushing assembly into a swinging motion of the stirring board. The shredded paper chips which typically form in a mound are thus pushed to the side and flattened. This helps reduce the space occupied by paper chips and increases the capacity of the trash bin, thus leading to less frequent emptying of the bin.

5 Claims, 3 Drawing Sheets

U.S. PATENT DOCUMENTS

| | | | | |
|---|---|---|---|---|
| 6,859,005 | B2 | 2/2005 | Boliver | |
| 6,889,604 | B2 * | 5/2005 | Ernst | 100/226 |
| 6,959,643 | B1 * | 11/2005 | Sammons et al. | 100/226 |
| 7,014,133 | B2 | 3/2006 | Ho | |
| 7,077,059 | B1 | 7/2006 | Cobb | |
| 7,150,422 | B2 | 12/2006 | Wang | |
| 2004/0129810 | A1 | 7/2004 | Kasprowicz et al. | |
| 2007/0145170 | A1 | 6/2007 | Easton et al. | |
| 2008/0156914 | A1 | 7/2008 | Huang | |
| 2008/0230640 | A1 | 9/2008 | Mussig et al. | |
| 2008/0283645 | A1 | 11/2008 | Mussig et al. | |
| 2009/0038437 | A1 | 2/2009 | Huang | |
| 2009/0050643 | A1 | 2/2009 | Wang | |
| 2009/0095831 | A1 | 4/2009 | Huang | |

* cited by examiner

SWINGING DEVICE FOR INCREASING CAPACITY OF TRASH BIN

CLAIM OF PRIORITY

This application claims priority to Foreign Application No. 096213791 filed in Taiwan, R.O.C., on Aug. 20, 2007.

BACKGROUND OF THE INVENTION

1. Field of Invention

The invention relates to a shredder and, in particular, to a swinging device for increasing the capacity of the trash bin for the shredder. Through the swinging motion of the swinging device, the space between paper chips is reduced to increase the trash bin capacity.

2. Related Art

As is well known, the action principle of a shredder for shredding paper is to dispose several cutting blades on two rotary shafts with spacers in between. A motor and a gear box are employed to drive the two parallel rotary shafts that rotate in opposite directions. They provide a shearing force on passing paper to cut it into small strips.

According to the mechanical cutting type, shredders can be classified as strip-cut shredders and cross-cut shredders. For strip-cut shredders, the cutting blades are disposed regularly on the rotary shafts and cut the paper along the longitudinal direction into long strips. For cross-cut shredders, each blade has several hook-shaped cutting edges. The blades are disposed in a spiral configuration on the rotary shafts. For such cross-cut shredders, the paper is not only cut along the longitudinal direction into strips, but also cut in the transverse direction into paper chips.

In the case of either strip-cut shredders or cross-cut shredders, they are usually sold with a trash basket or bin for accommodating shredded paper. As described above, a motor and a gear box are employed to drive the two parallel rotary shafts that rotate in opposite directions. The shearing force cuts the passing paper into small strips or chips, which then fall into the trash bin via the opening at the bottom of the shredder. Since the light paper strips or chips accumulate in an irregular way, the gap between then may be large. Therefore, the trash bin may quickly become full. Moreover, the paper chips typically accumulate in a mound or mountain shape below the paper outlet. When the height reaches the outlet, the paper chips prevent subsequent paper chips from falling. These paper chips may also get pulled back into the blades resulting in a paper jam.

To resolve this problem, a user need only stir and/or put pressure on the randomly accumulated paper chips. This leads to an increase in the capacity of the trash bin, so that the user does not need to empty it frequently. In addition, it can prevent paper jams from paper chips being pulled back into the blades.

SUMMARY OF THE INVENTION

An objective of the invention is to provide a swinging device for the user to manually operate, so that the paper chips are pushed and stirred to reduce the gap between them. This increases the capacity of the trash bin.

Another objective of the invention is to provide a swinging device for the user to manually operate, so that the paper chip shaped mound can be flattened. This prevents subsequently falling paper chips from being blocked and pulled back into blades which can result in a paper jam.

To achieve the above objectives, the invention provides a swinging device for increasing the trash bin capacity. The swinging device includes a pushing assembly which penetrates through the shredder body, a stirring board disposed at the bottom of the device, and a shaft connecting the pushing assembly and the stirring board. The shaft converts the vertical displacement motion of the pushing assembly into a swinging motion of the stirring board. The paper chips in the chip mound are thus pushed to the side and the mound is flattened. This reduces the space occupied by paper chips and increases the capacity of the trash bin. Thus, the user does not need to frequently clean the trash bin.

BRIEF DESCRIPTION OF THE DRAWINGS

The invention will become more fully understood from the detailed description given herein below. The following drawings are for illustration only, and thus should not limit the scope of the present invention.

DETAILED DESCRIPTION OF THE INVENTION

The present invention will be apparent from the following detailed description, which proceeds with reference to the accompanying drawings, wherein the same references relate to the same elements.

Figure 1:
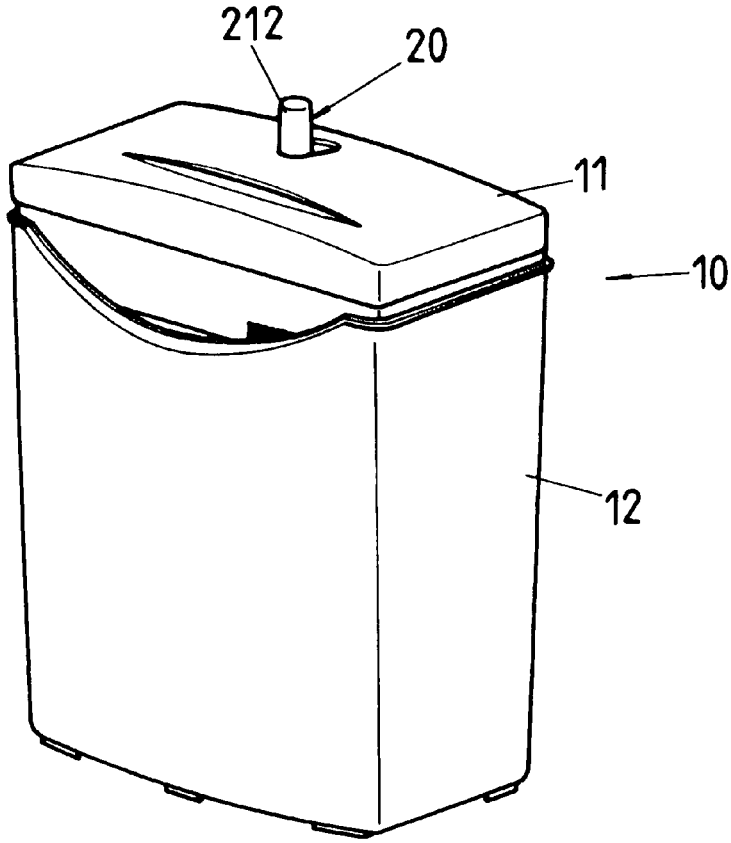
FIG. 1 is a three-dimensional view of the invention.

Please refer to FIG. 1. The body 11 of the shredder 10 is disposed on the top opening of the trash bin 12. The body 11 is formed with a hole 111 that passes through it.

Figure 2:
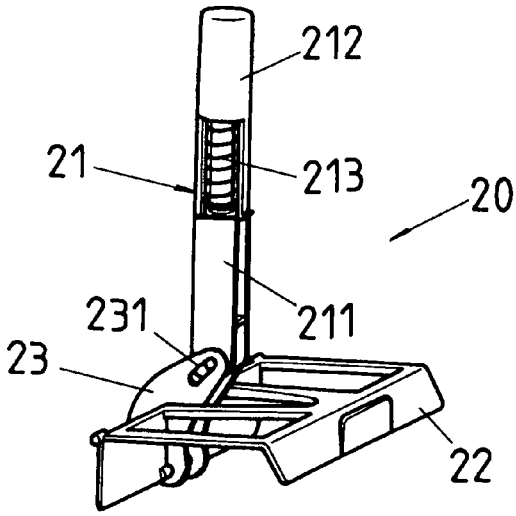
FIG. 2 is a three-dimensional view of the disclosed swinging device.
Figure 3:
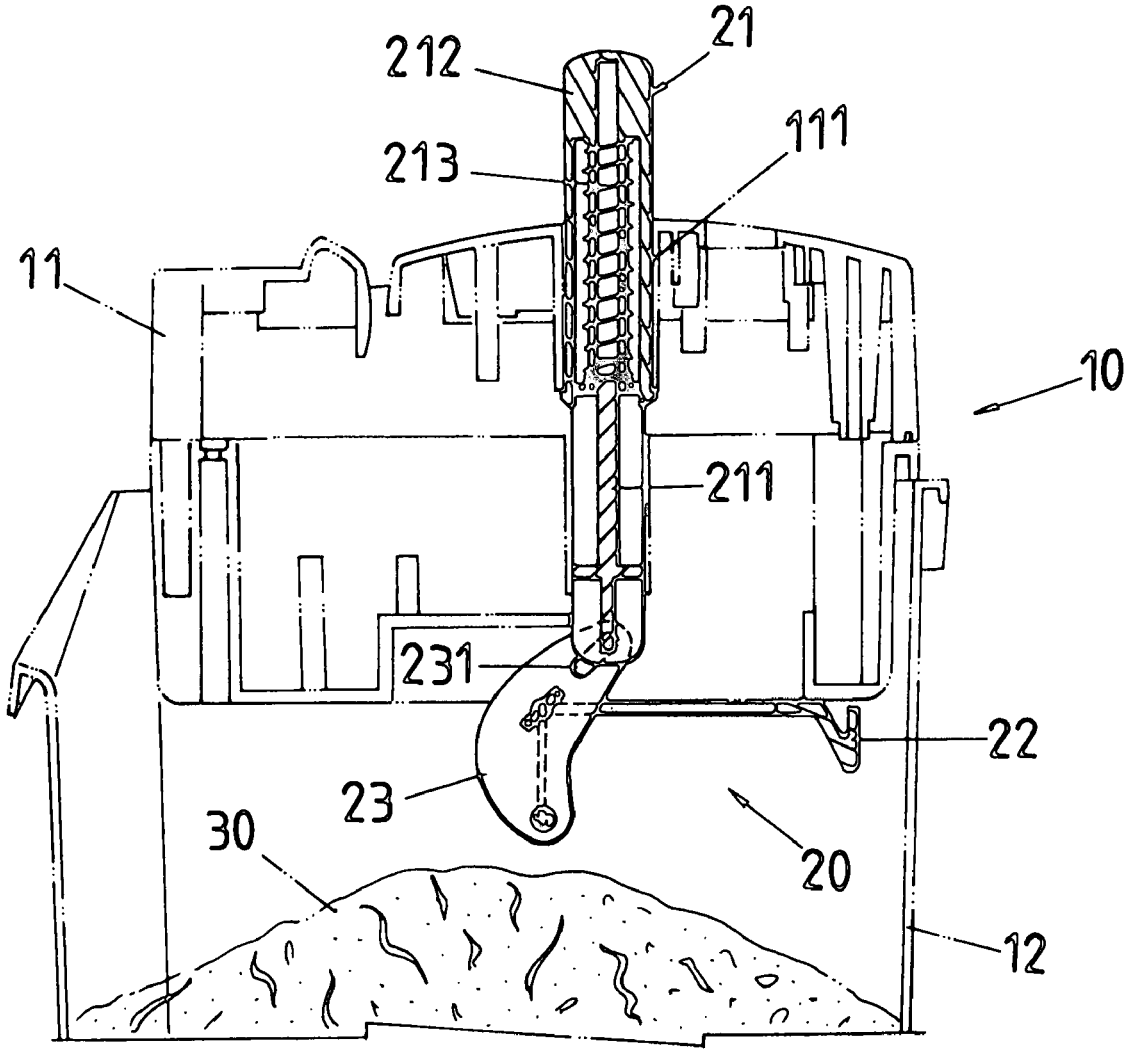
FIG. 3 is a cross-sectional view of the disclosed swinging device.

Please refer to FIG. 2. The swinging device 20 includes a pushing assembly 21, a stirring board 22, and a shaft 23. The pushing assembly 21 is disposed through the through hole 111 of the body 11. The stirring board 22 is disposed at the bottom of the body 11. The shaft 23 connects between the pushing assembly 21 and the stirring board 22 as a motion connection between them.

The center of the shaft 23 pivots and is disposed directly at the bottom of the body 11. The stirring board 22 and the pushing assembly 21 are on both ends of the shaft 23 that pivots. A hole 231 is formed on the end of the shaft 23 which couples with the pushing assembly 21. The shaft 23 converts the vertical motion of the pushing assembly 21 into the swinging motion of the stirring board 22.

The pushing assembly 21 further includes a through rod 211 which penetrates through the bottom of the body 11 and a pushing rod 212 which penetrates through the top of the body 11. The pushing rod 212 and the through rod 211 are coupled inside the body 11. The end of the through rod 211 that penetrates out of the body 11 is pivotally connected to the hole 231 of the shaft 23. One end of the pushing rod 212 sticks out of the body 11 for the user to manually press. A spring 213 is provided in the pushing assembly where the pushing rod 212 is mounted in the body 11, so that the pushing rod 212 is normally biased upwards.

Figure 4:
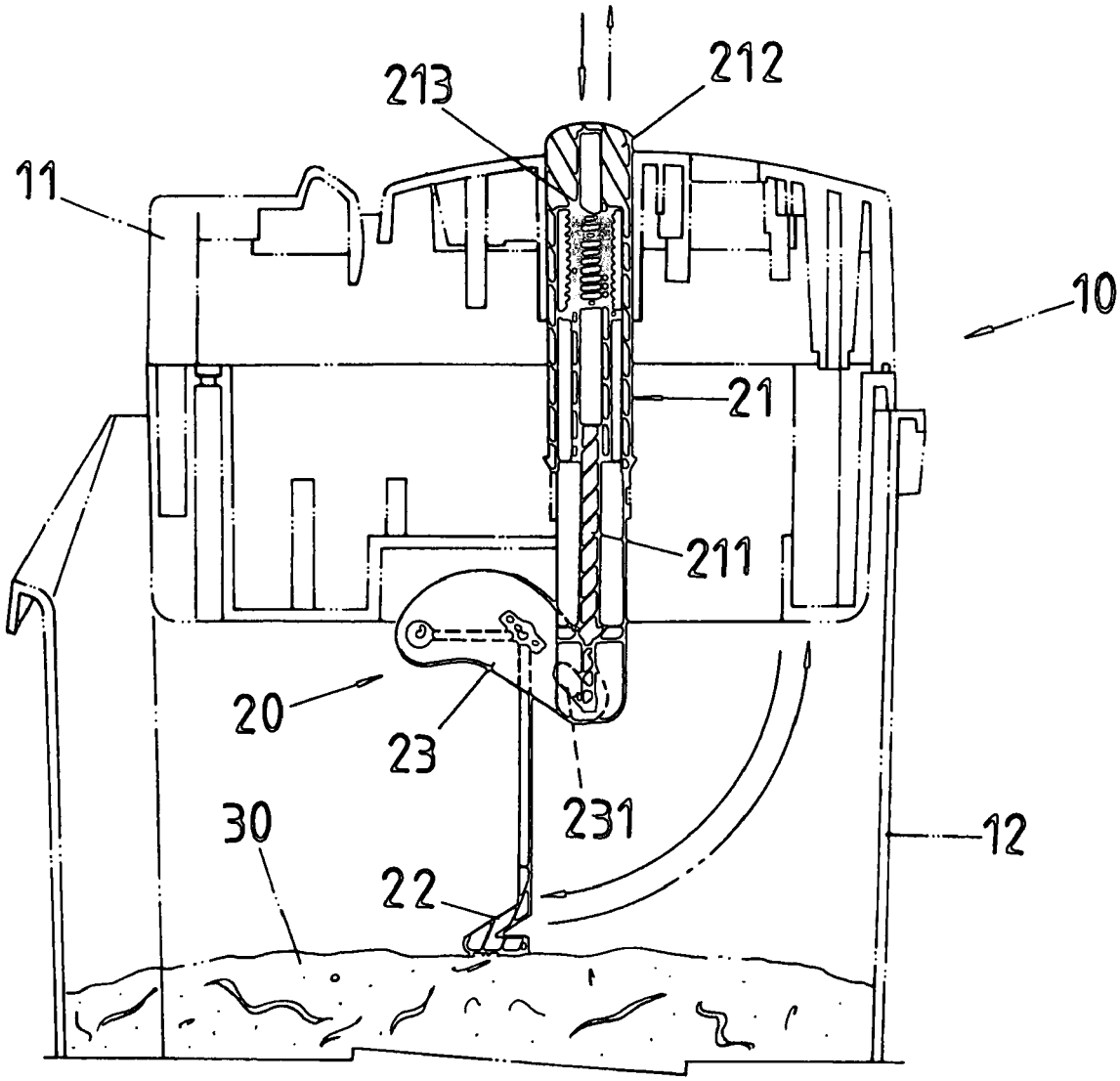
FIG. 4 shows the action of the disclosed swinging device.

As shown in FIG. 4, when the user manually depresses the pushing rod 212 above the body 11, the stirring board 22 in the lower portion of the body 11 pushes and stirs the paper chips 30 to reduce the space occupied by the chips. This effectively increases the capacity of the trash bin 12 and reduces the frequency for clearing out the paper chips. It also prevents the chips from forming in a mound and blocking subsequently falling paper chips or causing paper jams.

After the user releases the pushing rod 212, the pushing rod 212 and the through rod 211 are set back to their initial positions due to the restoring force of the spring 213. Through the connection of the shaft 23, the stirring board 22 is also brought back to its initial position. Repeating the above-mentioned pressing action causes the stirring board 22 to swing back and forth, pushing and flattening the paper chips.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A shredder with a swinging device for increasing the capacity of a trash bin comprising:

a shredder body;

a cutting mechanism located inside the shredder body;

a trash bin for containing shredded material;

a pushing assembly penetrating through the shredder body;

a stirring board disposed at the bottom of the shredder body; and a shaft connecting the pushing assembly and the stirring board which converts the vertical motion of the pushing assembly into a swinging motion of the stirring board, wherein the swinging motion of the stirring board prevents the shredded material from forming in a mound by stirring the shredded material and allowing it to resettle in a level fashion.

2. A shredder with a swinging device for increasing the capacity of a trash bin as in claim 1, wherein a hole is formed through the shredder body for the pushing assembly.

3. A shredder with a swinging device for increasing the capacity of a trash bin as in claim 1, wherein the pushing assembly includes a rod penetrating through the bottom of the shredder body and a pushing rod penetrating through the top of the shredder body.

4. A shredder with a swinging device for increasing the capacity of a trash bin as in claim 1, wherein the pushing assembly is provided with a spring at the position where the pushing rod is mounted in order to constantly push the pushing rod upward.

5. A shredder with a swinging device for increasing the capacity of a trash bin as in claim 1, wherein the center of the shaft is connected to the bottom of the body, with the stirring board on one end of the shaft, and the pushing assembly at the other end of the shaft.

* * * * *